US005101870A

United States Patent [19]

Farris

[11] Patent Number: 5,101,870

[45] Date of Patent: Apr. 7, 1992

[54] CONFORMING FUNNEL AND DISPOSABLE FLUID CONTAINER

[76] Inventor: Roy D. C. Farris, 1898 Phelphs Ave., Fremont, Nebr. 68025

[21] Appl. No.: 693,426

[22] Filed: Apr. 29, 1991

Related U.S. Application Data

[63] Continuation-in-part of Ser. No. 537,820, Jun. 14, 1990, abandoned.

[51] Int. Cl.[5] ..... B67C 11/00

[52] U.S. Cl. ..... 141/343; 141/98; 220/460; 220/538; 220/DIG. 6; 215/100 R; 206/223

[58] Field of Search ..... 141/98, 331-334, 141/337, 338, 340-343; 220/855 P, 85 F, DIG. 6; 215/100 R; 383/36; 206/223; 222/460, 461, 538, 539, 530

[56] References Cited

U.S. PATENT DOCUMENTS

| | | | |
|---|---|---|---|
| 34,004 | 12/1861 | Morrison | 141/343 |
| 129,024 | 7/1872 | George | 141/343 |
| 285,597 | 9/1883 | Eustis | 141/343 |
| 398,390 | 2/1889 | Greely | 141/343 |
| 589,659 | 9/1897 | Krack | 141/343 |
| 733,486 | 7/1903 | Jack | 141/340 |
| 782,736 | 2/1905 | Epperson | 141/343 |
| 790,080 | 5/1905 | Seavy | 141/343 |
| 1,898,112 | 2/1933 | Wright | 220/85.5 P |
| 2,238,253 | 4/1941 | Dick | 141/343 |
| 2,254,936 | 9/1941 | Dick | 141/343 |

*Primary Examiner*—Ernest G. Cusick
*Attorney, Agent, or Firm*—John A. Beehner

[57] ABSTRACT

A disposable fluid container and disposable funnel combination includes a container having a tubular neck protruding from one wall with a removable cap adapted to be secured onto the neck. A separate funnel has a wall portion which generally conforms to the top wall of the container and a generally tubular spout of a size and shape such that, upon inversion of the funnel and placement of the spout over and around the neck of the container, the funnel closely conforms to the container neck and walls.

14 Claims, 3 Drawing Sheets

CONFORMING FUNNEL AND DISPOSABLE FLUID CONTAINER

CROSS REFERENCE TO RELATED APPLICATION

This is a continuation of patent application Ser. No. 537,820, filed on June 14, 1990, abandoned.

BACKGROUND OF THE INVENTION

The present invention is directed generally to a conforming funnel for a disposable fluid container and more particularly to a disposable funnel that can be inverted to form-fit onto the top of a one quart oil container or the like and be removably secured thereon until the contents of the container are to be emptied.

Motor oil is generally sold in the retail consumer market in the new "easy pour" one quart oil containers having a spout protruding from the container and usually offset from the central axis of the container. Even with these new "easy pour" motor oil containers, it is still very difficult to pour oil into a vehicle motor without a funnel, primarily because there are so many obstructions around the oil filler hole that one cannot position the container for easy placement of the neck of the container into the oil filler hole without spilling oil onto the engine. For certain vehicles, such as large recreational vehicles, a different problem is encountered, namely that the oil filler tube is almost horizontal.

Perhaps due to the popularity of the "easy pour" oil containers" most service stations no longer provide funnels on the gasoline pump islands for use by motorists needing to add oil. The result is generally that the customer does the best he or she can to minimize the spillage onto the engine and/or ground adjacent the vehicle but inadvertently does spill some oil or other fluid.

Long prior to the popularity of disposable oil cans or containers, metal oil cans were known which were provided with a hinged funnel to facilitate pouring of the contents. Examples include Trent U.S. Pat. No. 60,806; Gates, U.S. Pat. No. 425,502; Jack, U.S. Pat. No. 733,486; and Cox, U.S. Pat. No. 1,074,697. It would not be practical, however, to provide such a hinged funnel on the now popular disposable oil containers because of the expense and increased size of the containers which would require different, bigger and less efficient boxes or cases for storing and shipping the oil containers.

Accordingly, a primary object of the present invention is to provide an improved combination disposable fluid container and conforming funnel.

Another object is to provide a disposable fluid container with a conforming disposable funnel.

Another object is to provide a conforming funnel for existing disposable fluid containers.

Another object is to provide a conforming funnel adapted to be removably secured to a disposable fluid container without modification of the container.

Another object is to provide a disposable conforming funnel for a fluid container which hardly changes the size and shape of the combination from the container itself whereby the combination containers and funnels can be packaged and shipped in the same case as conventionally used for the containers.

Another object is to provide a disposable fluid container with a readily accessible funnel.

Another object is to provide a combination disposable container and funnel wherein the container cap doubles as the mechanism for releasably securing the funnel on the container.

Another object is provide a combination disposable fluid container and funnel which is simple and rugged in construction, economical to manufacture and efficient in operation.

SUMMARY OF THE INVENTION

The present invention is directed to a conforming funnel and a disposable fluid container having a top wall which converges into an upright tubular neck through which fluid may be poured into and from the container. A cap is provided to cooperate with coacting securement means on the cap and neck for closing the container. The disposable funnel includes a wall portion which generally conforms to at least the top wall of the container. The funnel wall portion also converges into an upright tubular spout of a size to fit over the container neck. The wall portion and spout are of a size and shape such that, upon inversion of the funnel and placement of the spout over the container neck, the spout and wall portion closely conform to the container neck and top wall of the container.

In the combination of the container and funnel, the container cap doubles both as a closure for the container and the locking means for removably securing the funnel on the container prior to use. Upon removal of the cap, the funnel may be simply lifted off the top of the container, tipped over and positioned so that the spout is inserted into the opening into which fluid is to be poured, whereupon the contents of the container may be easily poured into the wide open end of the funnel.

DESCRIPTION OF THE PREFERRED EMBODIMENT

Figure 1:
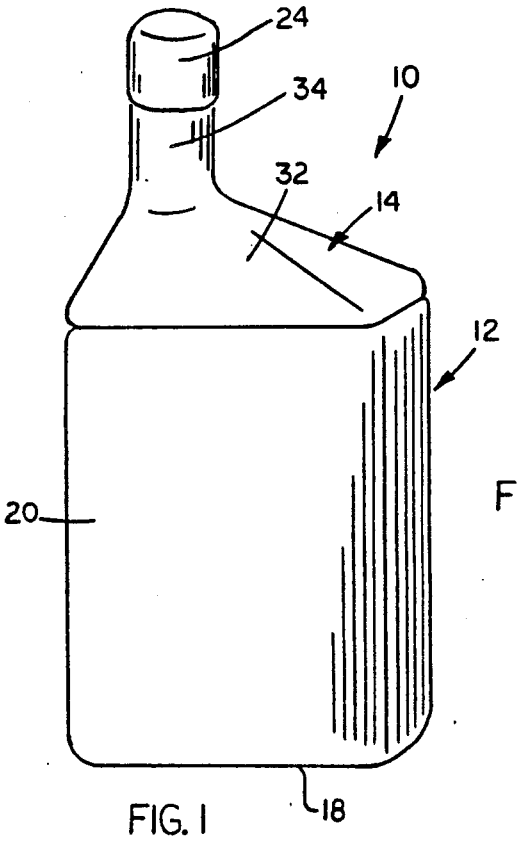
FIG. 1 is a perspective view of a combination fluid container and disposable funnel of the invention.

FIGS. 1–4 illustrate the combination 10 of a disposable fluid container 12 and a disposable conforming funnel 14.

Container 12 is illustrated as a plastic "easy pour" oil container having a top wall 16, bottom wall 18 and continuous peripheral sidewall 20 which cooperate to define an internal fluid containment chamber. The top wall 16 converges into an integrally formed upright tubular neck 22 through which fluid may be poured into and from container 12.

A cap 24 is provided for removably closing the opening 26 through the top of the container neck 22. To secure the cap on the neck, both are provided with coacting securement means. An example of which is illustrated as the male threads 28 on neck 22 and female threads 30 within the cap 24. In the alternative, a snap-on cap may be provided or any other type for closing the container until the contents are ready to be used.

Figure 2:
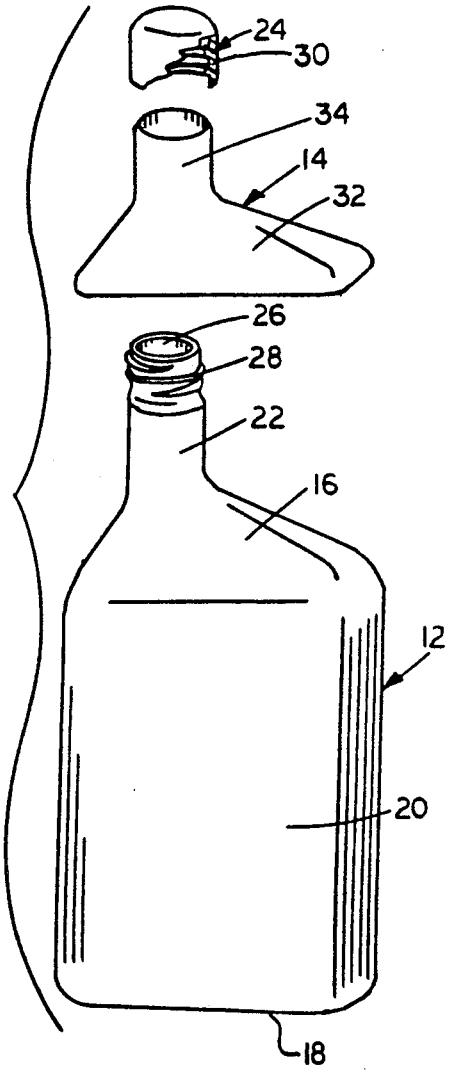
FIG. 2 is an exploded perspective view of the combination container and disposable funnel of the invention.
Figure 4:
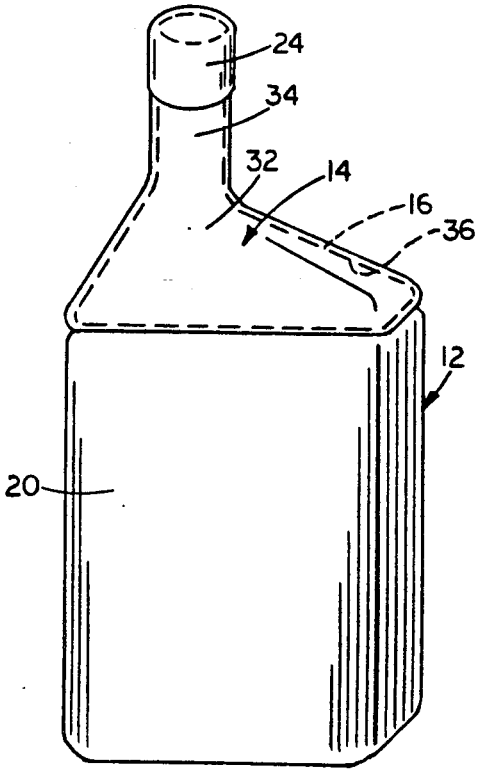
FIG. 4 is another perspective view of the combination container and funnel with the outline of the top of the container indicated in dotted lines.

The conforming funnel 14 includes a wall portion 32 which generally conforms to the container top wall 16 as shown in FIGS. 1 and 2. Wall portion 32 likewise converges into an upright tubular spout 34 which is of a size to fit over the container neck 22. The wall portion 32 and spout 34 are of a size and shape such that, upon inversion of the funnel, as illustrated in FIG. 2, and upon placement of the spout over the container neck, the spout 34 and wall portion 32 closely conform to the container neck 22 and top wall 16 respectively. Whereas "closely conform" preferably contemplates flush engagement between the adjoining surfaces to the maximum extent possible but for the threads 28, the term contemplates a less perfect match. Additional shades or protrusions may be formed on the funnel wall portion 32, for example which do not conform to any corresponding protrusions on container 12 but the parts will be considered as closely conforming so long as those surfaces which do contact one another are of generally the same shape and size for accurately seeding the funnel on the top wall of the container. FIG. 4 indicates by dotted lines, the engaged surfaces of the funnel 14 and container 12. It may be that ribs or contact buttons would be formed onto the container top wall 16 or interior surface 36 of funnel 14 which cause the surfaces to be spaced apart by a distance on the order of not more than one eighth inch ($\frac{1}{8}''$), for example, but so long as the funnel can be inverted and fit onto the container top wall 16 so as to positively seat thereon, it will be regarded as closely conforming.

To secure the funnel 14 onto the container 12, the cap 24 may be utilized so that no additional changes or structural additions need be made to the container. For this purpose, the height of the container neck 22 is preferably longer than the height of the spout 34 so that the externally threaded top portion of the neck 22 will protrude above the spout 34 to enable securement of the cap 24 thereon. Likewise, the width of the cap 24, i.e., its diameter in the illustrated embodiments, is greater than the width of the spout 34, i.e., its outside diameter, with the results that the cap serves to removably secure the funnel 14 onto the container 12, as illustrated in FIGS. 1 and 4.

Figure 3:
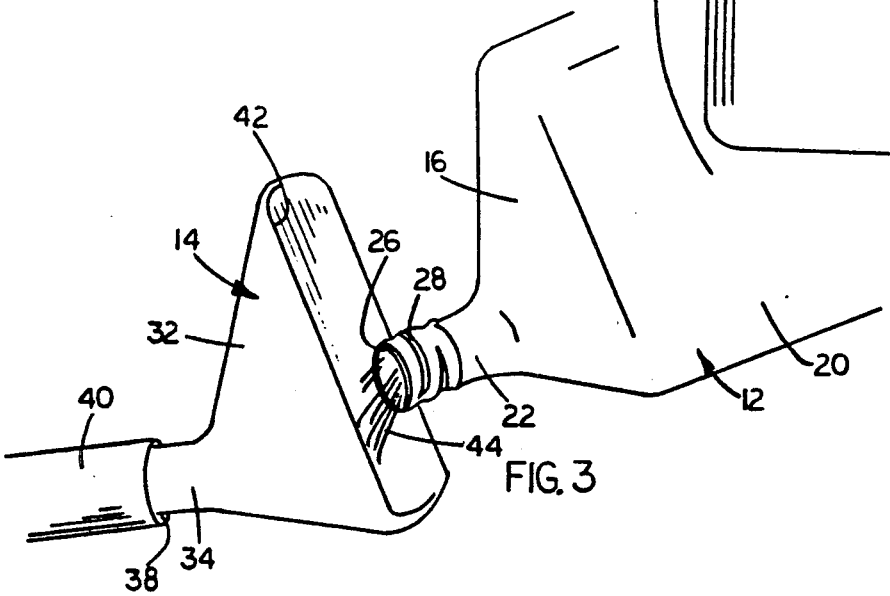
FIG. 3 is a partial perspective view showing the funnel in use for emptying the fluid contents of the container into an opening.

In operation, when the oil or other fluid contents of container 12 are to be poured into an opening, cap 24 is twisted off of neck 22 whereupon funnel 14 is raised off of the container, inverted or tipped right side up and positioned with spout 34 extending into a fluid filler opening 38 such as the generally horizontal oil filler tube 40 for a recreational vehicle as illustrated in FIG. 3. The funnel 14 serves to change the angle of the opening from almost upright to a far more slanted funnel opening as indicated at 42. It also substantially enlarges the opening into which the fluid is poured. Finally, it displaces the opening being filled away from the original opening 38 and any obstructions that may block close positioning of the container to the original opening 38. After the fluid 44 is emptied through the funnel 14 into opening 38, the container 12, funnel 14 and cap 24 are disposed of.

Figure 5:
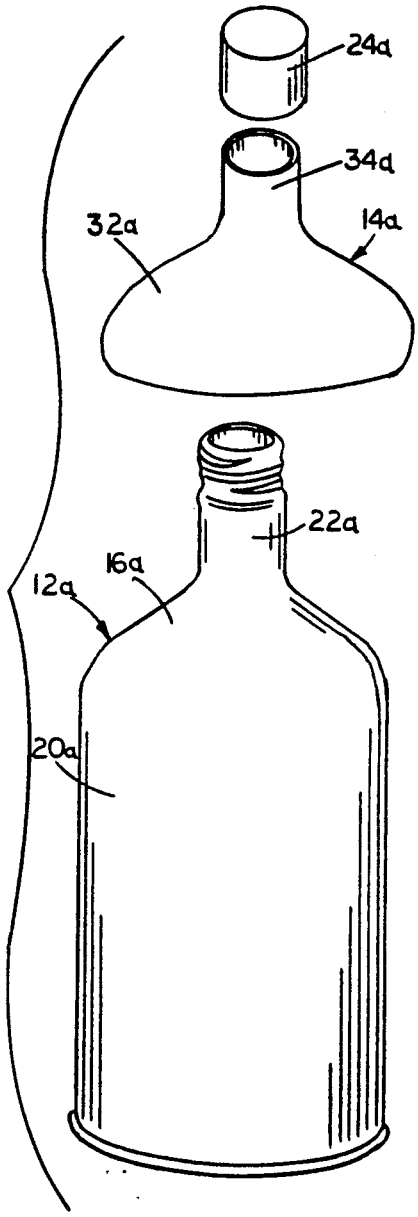
FIG. 5 is an exploded perspective view of an alternate embodiment of the invention.

An alternate embodiment of the invention is illustrated in FIG. 5 wherein the container **12*a* is generally circular in its transverse cross sectional shape and wherein the neck 22*a* is generally concentric with the container sidewalls 20*a*. Funnel 14 is of a size and shape such that, upon inversion of the funnel 14*a* to the position indicated in FIG. 5 and upon placement of the spout 34*a* over the container neck 22*a*, the spout 34*a* and funnel wall portion 32*a* closely conform to the container neck 22*a* and top wall 16*a*** respectively.

Figure 6:
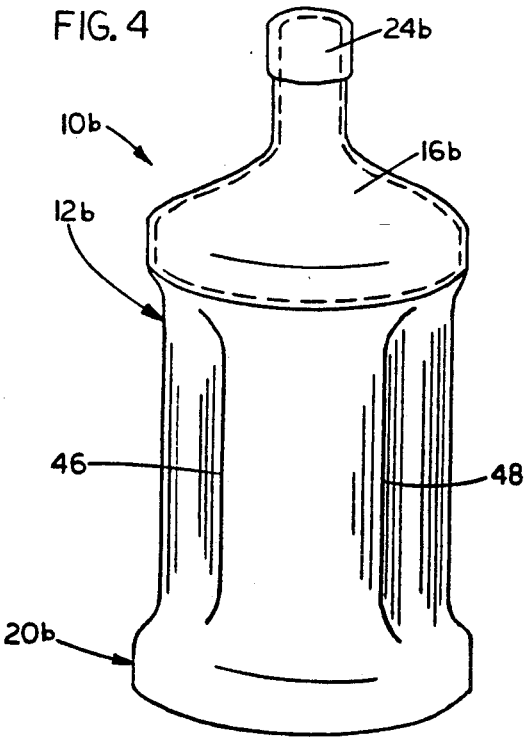
FIG. 6 is a perspective view of a still further embodiment of the invention.

A still further embodiment **10*b* is illustrated in FIG. 6 wherein sidewall 20*b* of container 12*b* has at least a pair of finger grip indentations 46 and 48 formed therein to facilitate gripping and handling of the container 12*b*. Whereas those indentations 46 and 48 are shown in connection with an otherwise somewhat cylindrical container like that illustrated in FIG. 5, such indentation could likewise be provided in the container of FIGS. 1–4**, or any other shaped container.

Figure 7:
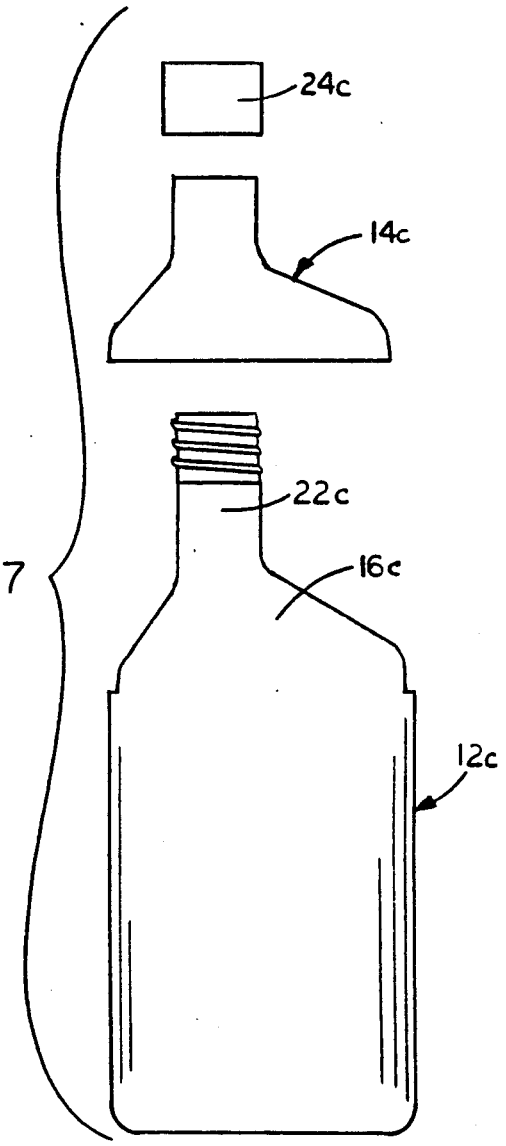
FIG. 7 is a partial exploded side elevational view of a container recessed for receiving the funnel thereon.
Figure 8:
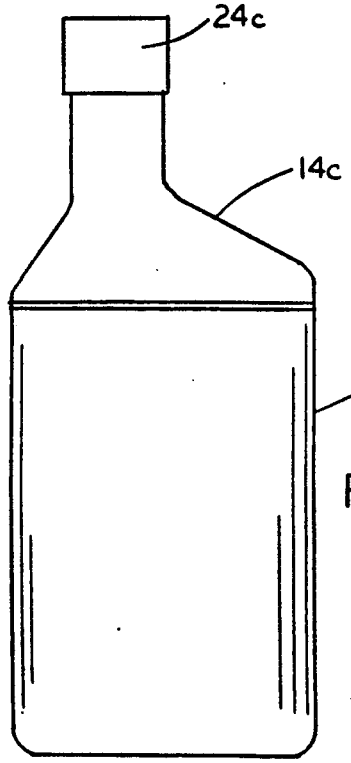
FIG. 8 is a partial side elevational view of the container/funnel combination of FIG. 7.

FIG. 7 and 8 disclose a further improvement for the invention wherein at least the top wall **16*c* of container 12*c* is slightly recessed by a dimension approximately equal to the wall thickness of the funnel 14*c* so that when the funnel is placed onto the container 12*c* as illustrated in FIG. 8, the exterior surface of the funnel 14*c* aligns with the adjacent exterior surface of container 12** so as not to have any protruding shoulders which might catch on clothing, the container or any obstruction.

Whereas the one quart oil can may be the most natural and common usage for the container/funnel combination of the invention, it is likewise appropriate for other automotive fluids such as brake fluid, hydraulic fluid, carburetor cleaner or anything else that gets poured into an engine, as well as for such non-automotive liquid containers as those for lawn and garden chemicals or corrosive or flammable chemicals, the spillage of which must be carefully guarded against. The invention is likewise suitable for containers of fluid that typically are poured into small openings, such as stem iron decalsifier.

The particular material that the container and funnel are made of is not critical to the invention. Certainly the plastic used in conventional oil containers is a natural selection as is a fluid tight treated paper material that is recyclable. The container and funnel may be formed of the same plastic material.

A significant advantage of the present invention is that the funnel is always there when and where it is needed. Every time a container is opened, the funnel is right at hand where it can be inverted and placed into the opening into which the fluid is to be poured. Thereafter, the funnel is simply disposed of with the container. There is no need to search for a permanent funnel nor to store a funnel between uses with different disposable containers. Whereas this combination affords a substantial advantage for the emptying of the contents of a fluid container, the combination container and funnel take up practically no more space than the container alone and, therefore, max be packed in the same case with virtually the same space efficiency as is currently known for such cases.

Whereas the invention has been described in connection with preferred embodiments thereof, it is understood that many modifications, substitutions and additions may be made which are within the intended broad scope of the appended claims.

Thus there has been shown and described a conforming funnel for a disposable fluid container which accomplishes at least all of the stated objects.

I claim:

1. In combination, a disposable container having a top wall, bottom wall and sidewalls defining a fluid containment chamber, said top wall converging into an upright tubular neck through which fluid may be poured into and from the container, a cap adapted to be removably placed on and to close said container neck, co-acting securement means on said cap and neck to removably secure said cap in closing relation over said neck, and a disposable funnel having a wall portion which generally conforms to the top wall of the container, said wall portion converging into an upright tubular spout of a size to fit over said container neck, and said wall portion and spout being of a size and shape such that upon inversion of the funnel and placement of the spout over the container neck, said spout and wall portion closely conform to the container neck and top wall, said cap being the sole operative means to removably secure said funnel on said container.

2. The combination of claim 1 wherein the width of the cap is greater than the width of said spout.

3. The combination of claim 2 wherein said container is generally cylindrical, said coacting securement means including male threads on said neck and female threads on said cap, and said funnel spout being of a length such that upon inversion of the funnel and placement of the spout over said neck, the male threads on said neck are exposed for securement of the cap thereon.

4. The combination of claim 3 wherein the length of said spout is less than the length of said neck.

5. The combination of claim 4 wherein the width of said cap is at least as great as the corresponding width of said spout.

6. The combination of claim 1 wherein said funnel wall portion has a concave interior surface which generally conforms to the container top wall and portions of said sidewalls.

7. The combination of claim 1 wherein said container and funnel are formed of the same plastic material.

8. The combination of claim 1 wherein said container and funnel are formed of the same recyclable paper material.

9. The combination of claim 1 wherein said container has a non-circular cross sectional shape and said neck is offset from the central axis of the container toward one sidewall.

10. The combination of claim 1 wherein said container has a generally circular cross sectional shape and said neck is generally concentric with the container sidewalls.

11. The combination of claim wherein said container comprises a one quart bottle.

12. A container and funnel combination comprising, a container having walls defining a fluid containment chamber and a tubular neck connected to and protruding from at least one wall through which fluid may be poured into and from the container, a cap and coacting securement means on said neck and cap to removably secure said cap in closing relation over said neck, and a funnel having a wall portion which generally conforms to the walls of said container and a generally tubular spout connected to and protruding from said wall portion; said wall portion and spout being of a size and shape such that upon inversion of the funnel and placement of the spout over and around said neck, said spout and wall portion closely conform to the container neck and walls, said cap being the sole operative means to removably secure said funnel on said container.

13. The container and funnel combination of claim 12 wherein the width of said cap is greater than the width of said spout.

14. The container and funnel combination of claim 12 wherein at least the top wall of said container is recessed by a dimension generally equal to the wall thickness of said funnel whereby, upon placement of the funnel onto the container, the exterior surface of the funnel is generally aligned with the adjacent exterior surface of the container.

* * * * *